United States Patent [19]

Chiabrandy

[11] 4,210,058

[45] Jul. 1, 1980

[54] BALANCED GATLING GUN

[75] Inventor: Robert E. Chiabrandy, Burlington, Vt.

[73] Assignee: General Electric Company, Burlington, Vt.

[21] Appl. No.: 945,656

[22] Filed: Sep. 25, 1978

[51] Int. Cl.[2] ..... F41D 7/04

[52] U.S. Cl. ..... 89/12; 89/9

[58] Field of Search ..... 89/12, 11, 9, 7, 1 L

[56] References Cited

U.S. PATENT DOCUMENTS

| | | | |
|---|---|---|---|
| 2,849,921 | 9/1958 | Otto | 89/12 |
| 2,872,847 | 2/1959 | Otto | 89/12 |
| 2,971,440 | 2/1961 | O'Brien | 89/12 X |
| 3,303,744 | 2/1967 | Lanizzani | 89/129 X |
| 3,380,343 | 4/1968 | Chiabrandy et al. | 89/12 |
| 3,834,272 | 9/1974 | Patenaude et al. | 89/12 |
| 4,062,266 | 12/1977 | Elmore et al. | 89/11 X |
| 4,167,888 | 9/1979 | Pechamat et al. | 89/11 |

OTHER PUBLICATIONS

Technical Report AFATL-TR-73-130, vol.-1, Jun. 1973, Air Force Armament Laboratory, Eglin AFB, Fla.

*Primary Examiner*—David H. Brown

*Attorney, Agent, or Firm*—Bailin L. Kuch

[57] ABSTRACT

An arrangement of the components of a revolving battery gun such that the center of gravity of the assembly is located on the axis of the firing barrel at the time of its maximum recoil thrust. The required location of the center of gravity is achieved by the use of a relatively small number of barrels in a Gatling gun having a two-revolution main cam. Such a configuration permits the firing barrel to be placed relatively near to the gun rotor axis and permits the gun feeder, as well as the drive, recoil adapters, and other accessory devices to be placed on the same side of the gun as the firing barrel. In this location, the accessory devices counterbalance the weight of the rotor and barrel cluster, thereby placing the center of gravity of the assembly approximately on the axis of the firing barrel. The recoil thrust then passes through the center of gravity of the recoiling mass, eliminating pitch and yaw moments.

9 Claims, 17 Drawing Figures

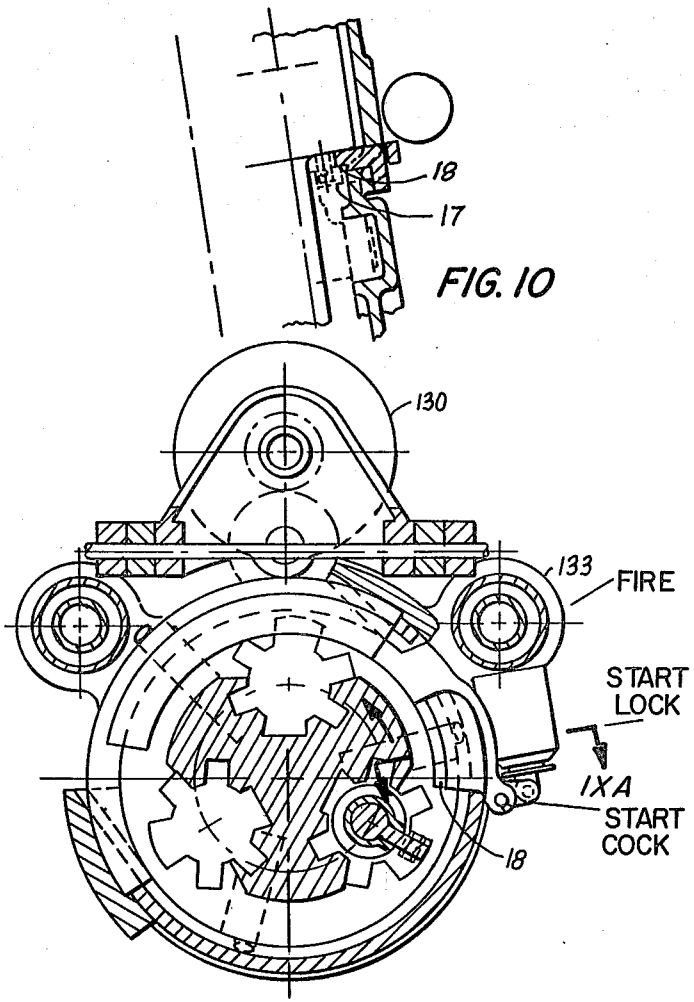
FIG. 10
FIG. 9
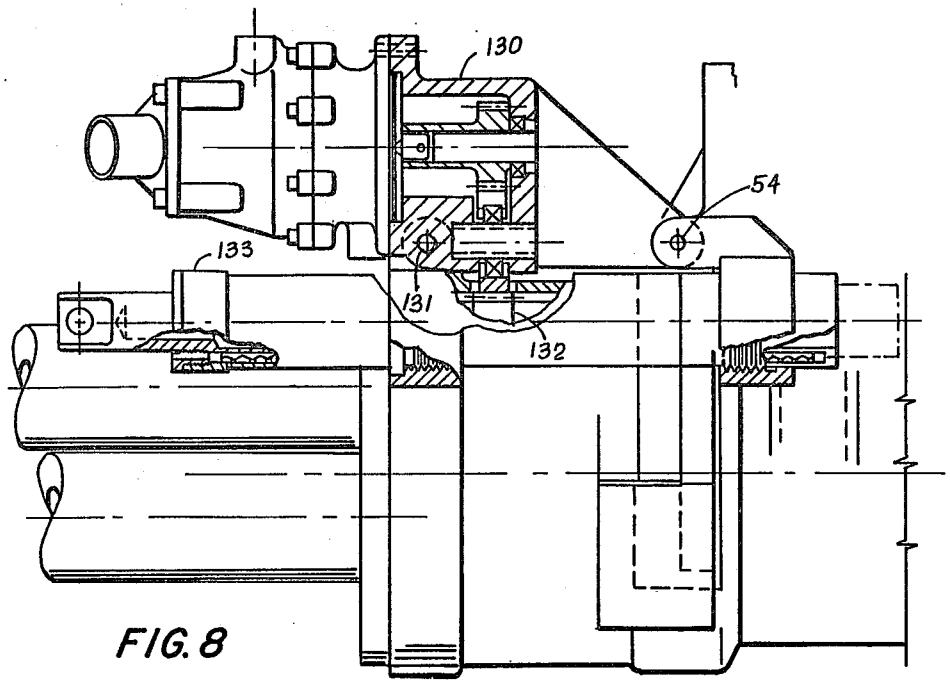
FIG. 8

BALANCED GATLING GUN

RELATED CASE

Certain subject matter disclosed in this application is claimed in Ser. No. 945,657 filed Sept. 25, 1979.

BACKGROUND OF THE INVENTION

1. Field of the Invention

This invention relates to revolving battery guns, e.g. Gatling Guns, and especially to an arrangement for substantially eliminating the recoil moment in the pitch and yaw planes due to the firing of each gun barrel during the rotation of the battery.

2. Prior Art

In U.S. Pat. No. 125,563, issued Apr. 9, 1872 to R. J. Gatling, there is shown the classic modern revolving battery gun. A stationary main cam is in a housing which encloses and supports a rotating receiver assembly which has a plurality of barrels and a like plurality of chambers and bolts. Rounds of ammunition are serially passed through the housing and handed to each bolt in turn as it passes the feeding station. This principle of operation has become conventional, as shown, for example, in U.S. Pat. No. 2,849,921, issued Sept. 2, 1958 to H. McC. Otto, and U.S. Pat. No. 3,380,343, issued Apr. 30, 1968 to R. E. Chiabrandy et al.

The center of gravity of a typical Gatling gun does not lie on the axis of the firing barrel. As a consequence, firing of the gun generates a recoil moment in the pitch and yaw planes: a moment which must be resisted by the gun mount as well as by the structure of the gun itself. The moment thus developed manifests itself in undesirable lateral loads passed into the mount, as well as in increased dispersion and, in extreme cases, increased gun power consumption.

SUMMARY OF THE INVENTION

An object of this invention is to eliminate the pitch and yaw recoil moments of a revolving battery gun.

A feature of this invention is an arrangement of the components of a revolving battery gun such that the center of gravity of the assembly is located on the axis of the firing barrel at the time of its maximum recoil thrust. The required location of the center of gravity is achieved by the use of a relatively small number of barrels in a Gatling gun having a two-revolution main cam. Such a configuration permits the firing barrel to be placed relatively near to the gun rotor axis and permits the gun feeder, as well as the drive, recoil adapters, and other accessory devices to be placed on the same side of the gun as the firing barrel. In this location, the accessory devices counterbalance the weight of the rotor and barrel cluster, thereby placing the center of gravity of the assembly approximately on the axis of the firing barrel. The recoil thrust then passes through the center of gravity of the recoiling mass, eliminating pitch and yaw moments.

BRIEF DESCRIPTION OF THE DRAWING

These and other objects, features and advantages of the invention will be apparent from the following specification thereof taken in conjunction with the accompanying drawing in which:

FIG. 8 is a detail side view of the gun of FIG. 1;

FIG. 9 is a transverse view in cross-section of the gun of FIG. 1, taken along the plane IX—IX of FIG. 3;

FIG. 10 is a detail of FIG. 9;

DESCRIPTION OF THE INVENTION

Figure 1:
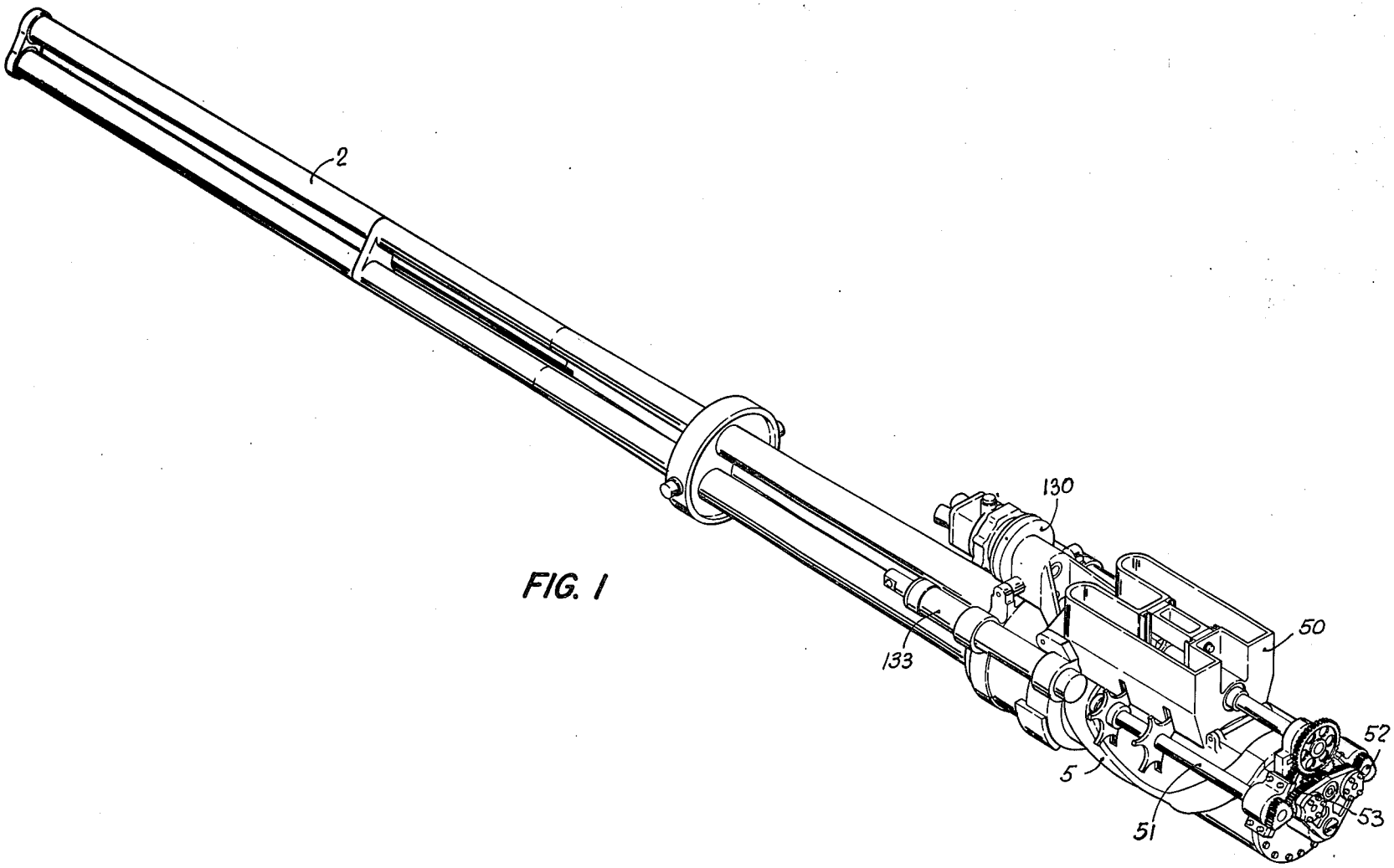
FIG. 1 is a perspective view of a gun embodying this invention.
Figure 2:
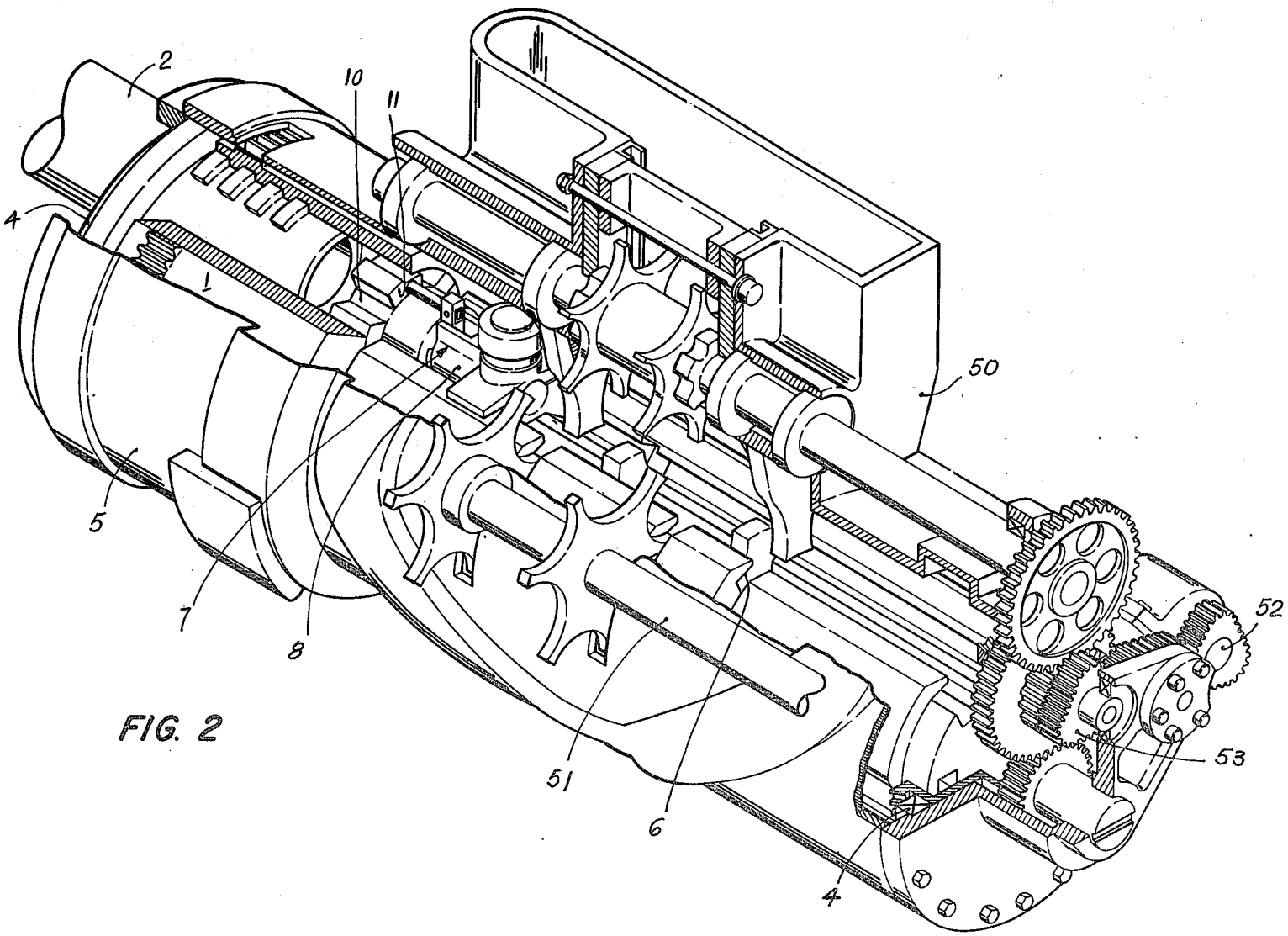
FIG. 2 is a detail perspective view of the gun of FIG. 1.
Figure 6:
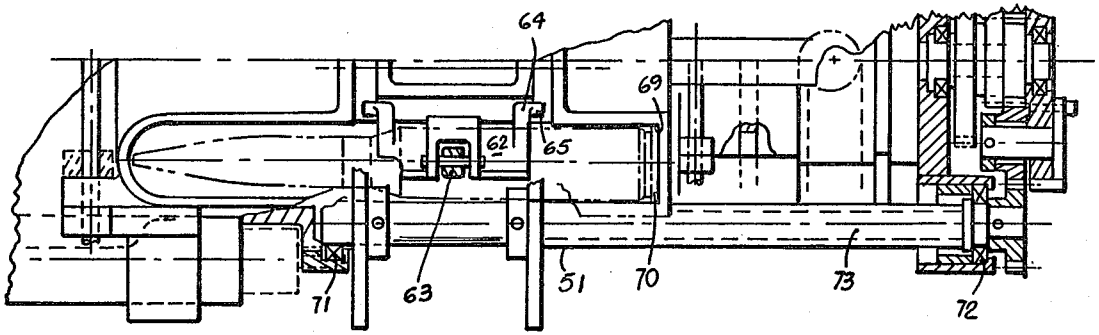
FIG. 6 is a top view of the gun of FIG. 1.
Figures 11, 12, 13, 14:
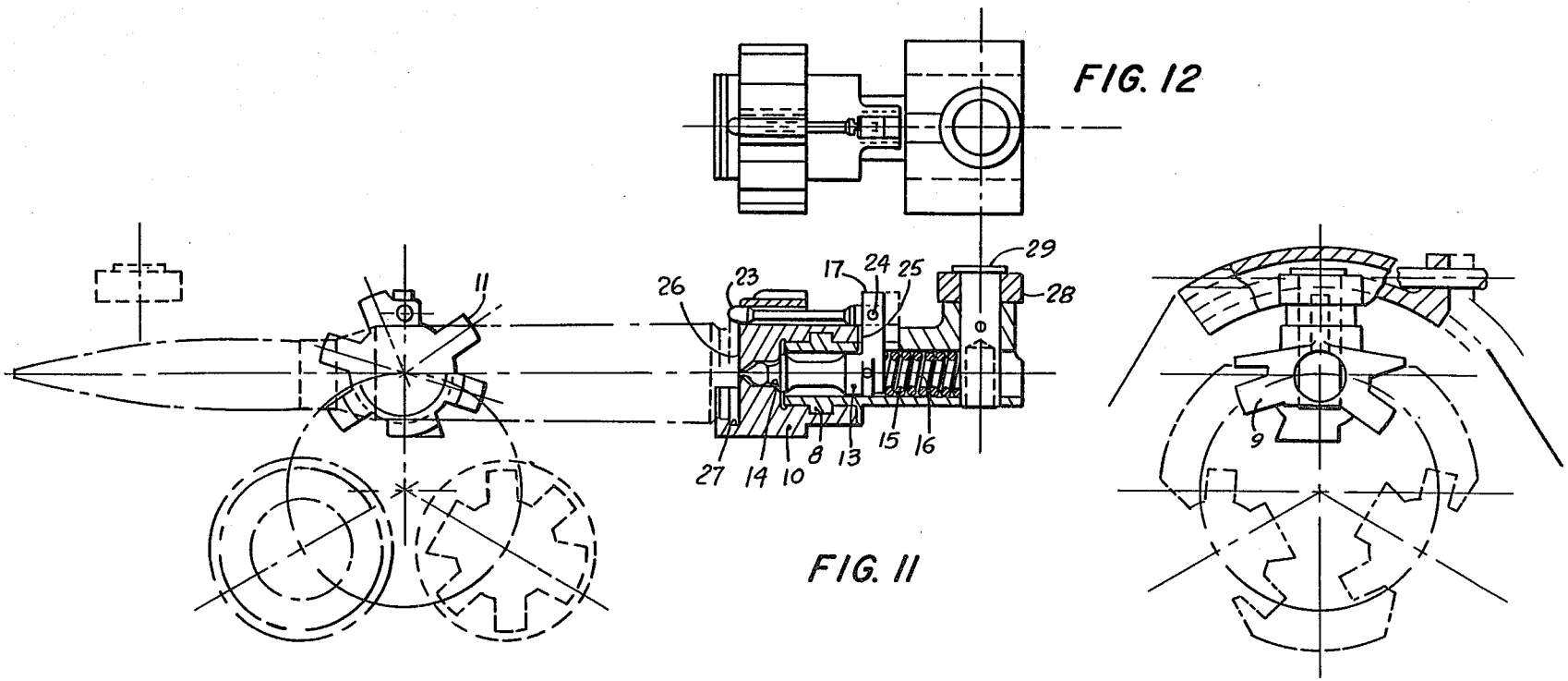
FIGS. 11, 12, 13 and 14 are several detailed views of the gun bolt incorporated in the gun of FIG. 1.

A balanced Catling gun is shown in FIG. 1. A rotor [1], to which are fixed a plurality of gun barrels [2], here shown as three, is rotatably supported by bearings [3], [4] in a gun housing [5]. The rotor [1] is equipped with track ways [6] which provide lateral support and guidance for a plurality (one for each barrel) of axially slidable bolt assemblies [7]. A bolt assembly is shown in FIG. 11. Each bolt includes a body [8] provided with feet [9] configured to slidably engage the aforementioned track ways [6] and a head [10] having locking lugs [11] configured to slidably engage the track ways. The head [10] is rotatably supported on the forward end of the body [8], so that the head can be rotated in and out of engagement with locking lugs [12] of the rotor when the bolt is at the forward end of its travel in the track ways [6]. Each bolt includes a firing pin [13] slidably mounted in concentric bores [14], [15] in the head and body respectively, and urged forward by a spring [16] in the bolt body. To the firing pin is fixed a cocking lug [17] adapted to be slidably engaged by a cocking cam [18] fixed to the gun housing, and by a retractor cam [19] formed partially on a bolt access cover [20] and partially in gun housing [5]. This access cover is removably fixed to the gun housing by pin and slot means shown at [21] and [22]. A rim retainer plunger [23] is slidably mounted in each bolt head [10] and fixed by pin means [24] to the cocking lug [17]. Cam means [25] are provided to withdraw and hold the firing pin [13] rearward of the bolt face [26] when the bolt head is in unlocked position. In this position, the rim retainer plunger [23] continues to extend forward of the bolt face, urged forward by a spring [16]. Each bolt head is provided with an extractor lip portion [27], which lip is configured to engage and retain the rim portions of cartridge cases. On each bolt, a cam follower roller [28] is rotatably mounted by a shaft [29] fixed to the bolt body. The roller [28] engages a fixed two-revolution bolt drive cam [30] formed on the inside of the gun housing [5] and access cover [20] and is adapted to drive the bolt [7] through one complete cycle of operation from the rearward extreme of bolt travel, or rear dwell, to the forward extreme of bolt travel, or front dwell, and back to the rearward extreme of bolt travel, in the period of two complete revolutions of the gun rotor.

Approximately radial with respect to the longitudinal axis of the rotor [1] are three bores [31] which slidably support respective locking plungers [32], said plungers having camming surfaces [33] to engage and drive locking lugs [11] to provide rotation of bolt heads [10] in locking and unlocking the breeches. Said plungers have, at their outer ends, hook portions [34] adapted to engage and be driven outward from the rotor axis by a locking cam [35] and an outer bearing portion [36] which engages and is driven inward by unlocking cam [37] and auxiliary unlocking cam [38]. All three of the aforementioned locking and unlocking cams are fixed to the gun housing [5].

Extending forward from the rear of the rotor, coincident with the axis of the rotor is a series of bores [39] in which a splined guide support [40] is radially supported by bearing means [41] at the forward end of the guide support [40]. The rear of the guide support [40] is fixedly supported by a bore [42] and pin means [43] in the gun back plate [44], and said back plate is, in turn, fixed to gun housing [5] by screws [45]. Inner guide vanes [46] are radialy supported and fixed against rotation by the splined guide support [40] and axially supported by internal slots [47] in the rotor. The inner guide vanes have guide portions [48] which cooperate with guide surfaces hereinafter described to control the path of cartridges [49] entering and leaving the gun.

The cartridge feeding mechanism of the gun is comprised of a feed conveyor turn-around unit, shown generally at [50], a load shaft assembly [51], an unload shaft assembly [52], and feed drive gearing, shown generally at [53]. The feed mechanism is substantially symmetrical about center line D—D of FIG. 4. It is, therefore, to be understood that all components on one side of center lines D—D are replicated by mirror image components on the other side, and that all actions of the mechanism on one side are performed in reverse order on the other side. The turn-around unit [50] is fixed to the gun housing by pin means [54] and by a second pin means (not shown) between the rear bearing block [55] and gun back plate [44]. Said pin means, in cooperation with rotatable turn-around shaft [56], bearing means [57] and [58], and turn-around unit housing [59] provide releasable fixation of the turn-around unit housing to the gun housing. Turn-around sprockets [60] and [61] are fixed to the turn-around shaft [56] and are configured to engage and drive ammunition feed conveyor elements [62], the elements being rotatably connected by pin means [63] to form a continuous chain. The conveyor elements incorporate guide projections [64] which slidably engage conveyor guides [65] fixed to the turn-around unit housing. The turn-around unit housing has outer guide vane portions [66] which have guide surfaces [67] to direct the ammunition out of the feed conveyor elements into the gun, in cooperation with turn-around housing guide surface [68] and rim guide portion [69], which slidably engages the extractor rim [70] of the cartridge case.

Mounted to the side of the gun housing [5] and to the back plate [44] are bearing means [71] and [72] respectively, which locate and support the load shaft assembly [51] for rotation about a fixed axis. The load shaft [73], journaled for rotation, has affixed thereto a pair of load sprockets [74] in which are formed pockets [75] for receiving and driving cartridges from the conveyor turn-around to the gun rotor track ways. The aforementioned rotor [1] has circumferential grooves [76] to provide for its rotation past the load sprockets [74] and the outer guide vane portions [66] of the turn-around unit. In order that the load sprockets may receive cartridges moving at relatively low speed in the conveyor elements [62] and deliver cartridges at a substantially higher speed to the bolts [7] of the gun, the load (or unload) shaft is driven by a train of non-circular gears [77]. The non-circular gear train causes a cyclic variation of the rotational speed of the load sprockets so that the desired transport of ammunition from conveyor element to sprocket is made when the sprocket speed is near its minimum, and so that the transport from sprocket to rotor occurs when the sprocket speed is near its maximum. The feed drive gearing contains, in addition to the non-circular gears [77], circular gearing by which drive power is transmitted from the gun rotor [1] to a countershaft [79] journaled in the gun back plate and supporting and driving the input gear of the non-circular train(s), and from the countershaft to the conveyor turn-around shaft [56].

Fixed to the rear of the gun rotor is a rear rotor gear [100] having a spur gear portion [101], which meshes with and drives the feed drive gearing [53], and a cone gear portion [102]. A crossover drive housing [103] is fixed to the gun housing [5] by brackets [104] and [105]. A crossover drive shaft [106] is journaled within the crossover drive housing by radial bearing means [107] and thrust bearing means [108], said crossover drive shaft having a pinion portion [109] at its forward end. At the rearward end of the crossover drive shaft is a gear [110] fixed to said shaft by pin means [111], said gear meshing with and driven by cone gear portion [102] of the rear rotor gear. Journaled in the gun housing [5] by bearing means [112] is a crossover switch [113] to which switch is affixed a face gear [114] by means of rabbet [115], screw [116], and pin [117]. Said face gear meshes with, and is driven by pinion portion [109] of the crossover drive shaft [106]. The axis of rotation [H] of crossover switch [113] intersects and is perpendicular to the axis of rotation of the gun rotor and is displaced a distance [J], parallel to the axis of the gun rotor, from the intersection [K] of the ram portion [118] and extract portion [119] of the bolt drive cam [30]. A crossover guide slot [120] is provided in the crossover switch, said guide slot being symmetrical with respect to the axis of rotation H of the crossover switch. The guide slot is preferably wider at the center of the switch than at the periphery, so that the cam follower roller is permitted to follow a helical path during its passage across the switch. The gearing comprised of cone gear [102], gear [110], pinion portion [109] and face gear [114] drives the crossover switch [113] at an average speed which is equal to one-fourth of the gun rotor speed multiplied by the number of bolts or barrels in the gun. Said gearing is timed so that an end of the slot [120] is aligned with the cam [30] coincident with the entry of each bolt roller [28] into the switch. Offset distance [J] and the diameter of the switch are determined as functions of the slope of the bolt drive cam so that the opposite end of slot [120] is subsequently aligned with the cam coincident with the exit of the bolt roller from the switch.

A gun drive assembly, shown generally at [130] in FIGS. 8 and 9, is mounted to the gun housing by pin means [54] and [131] and drives the gun by way of forward rotor gear portion [132] of the gun rotor. Recoil adapters, fixedly attached to the gun and shown generally at [133], provide resilient spring connection between the gun housing assembly and its firing mount. The drive and recoil adapters are located such that their masses augment the mass of the feed mechanism with the objective of counterbalancing the masses of the gun rotor, barrels, and bolts with respect to the firing barrel.

Figure 3:
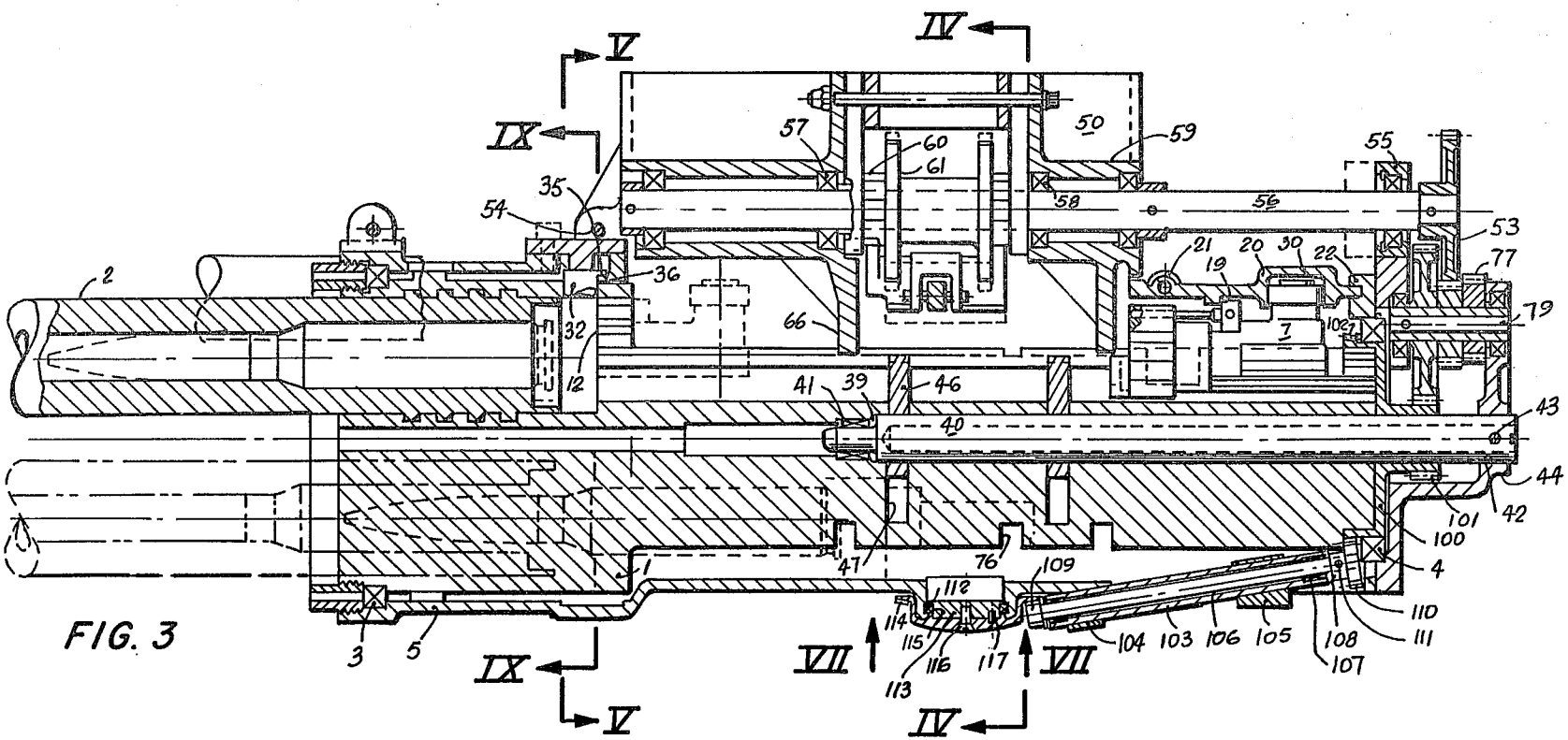
FIG. 3 is a side view in longitudinal cross-section of the gun of FIG. 1, taken along plane III—III of FIG. 4.

In operation, the gun rotor [1] is driven at substantially constant speed, and, in turn, drives the feed conveyor turn-around shaft [56] at similarly constant speed through the feed drive gearing [53]. For the configuration shown, with a six-tooth turnaround sprocket, a three-tooth load sprocket, and a two-revolution three barrel gun, the average speed of the turn-around sprocket is one-fourth of rotor speed. The crossover switch [113] is driven through gearing [102], [110], [109] and [114] at similar constant speed, while the load shaft assembly [51] and unload shaft assembly [52] are driven at cyclically varying speed by means of non-circular gears [77]. Ammunition enters the turn-around unit in feed conveyor elements [62], which are engaged and driven by turn-around sprockets [60] and [61]. Driven by the conveyor elements and guided by the outer guide vanes [67] and turn-around housing surfaces [68] and [69], the ammunition is delivered to the load sprockets [74] as the speed of the sprockets, fixed to load shaft [73] reaches the minimum of its cyclic variation and again begins to increase. At said minimum speed, the cartridge passes smoothly from the conveyor elements to the load sprockets. As the load sprockets turn through one-half tooth of rotation, the cyclically varying speed increases to a maximum, thereafter decreasing so that at slightly less than maximum speed, as the cartridge passes between the center lines of the load shaft and rotor, it is smoothly transferred from the load sprockets to the extractor lip portion [27] of the bolt assembly [7], said bolt assembly being, at that time, in the rear portion of the bolt driving cam as shown in FIG. 3. Since the average speed of the load sprocket is only one-half of the gun rotor speed, ammunition is fed to every other rotor track way which passes under the load shaft. The bolts in the alternate track ways are at the forward extreme of their travel in the rotor as they pass the load shaft.

Figure 5:
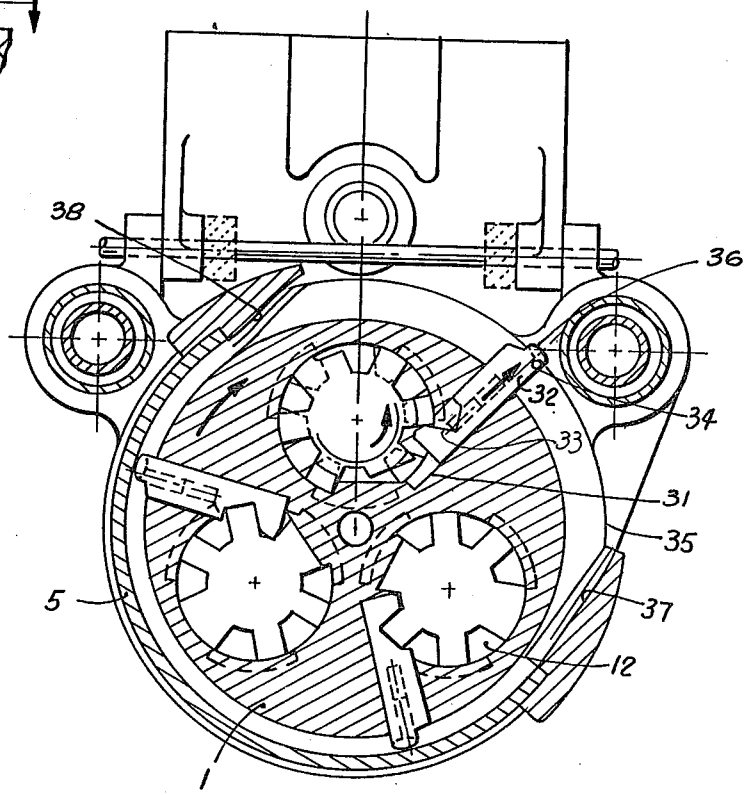
FIG. 5 is a transverse view in cross-section of the gun of FIG. 1, taken along the plane of V—V of FIG. 3.
Figure 7:
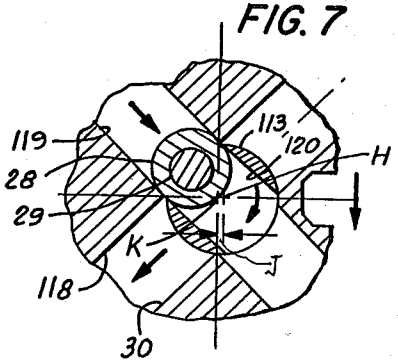
FIG. 7 is a detail bottom view in cross-section of the gun of FIG. 1, taken at VII—VII of FIG. 3.

The rim retainer plunger [23] is retracted by retractor cam [9] to permit entry of the cartridge into the extractor lip of the bolt. Path of the ammunition during the aforementioned speed increase and transfer to extractor lip is controlled by housing guide surfaces [68] and [69], and first by the outer guide vanes [67] and later by the inner guide vanes [46]. The cartridge having been seated and held in the extractor lip by housing surface [68], the cocking lug [17] of the bolt assembly (FIG. 11) is carried to the end of the retractor cam by continuing rotor rotation. At the end of said cam, the rim retainer plunger, urged by a spring [16] moves forward over the rim of the cartridge until the cocking lug reaches and is held by cam means [25], with the attached firing pin positioned rearward of the bolt face, retaining said cartridge in the extractor lip of the bolt throughout the ramming or forward motion of the bolt. The bolt, driven by the interaction of the cam follower roller [28] with the bolt drive cam [30] (FIG. 7) moves forward through approximately two-thirds of a revolution of the rotor. Approximately half way through its ram stroke, the cam follower roller reaches the point at which the ram portion [118] of the bolt drive cam intersects the extract portion [119]. Just prior to said intersection point, the cam follower roller enters one end of the crossover guide slot [120], said end being instantaneously in alignment with the cam to permit entry of the roller into the slot. Just after said intersection point, the cam follower roller leaves the other end of the crossover guide slot. The crossover switch having rotated through a small angle during the passage of the roller from one end of the slot to the other, said other end of the slot is aligned with the ram portion of the cam to permit the exit of the roller from the slot. Since the crossover switch is driven one-fourth revolution for each one-third revolution of the gun rotor, the crossover guide slot will be aligned to receive and guide through the intersection the bolt in the following rotor track way, the roller of the latter bolt being in the extract portion of the bolt drive cam. Continued rotation of the switch will continue to provide passage and guidance for cam follower rollers, alternating between the ram portion and extract portion of the cam. At the completion of the ram stroke, the rotation of the gun rotor brings the cocking lug [17] of the firing pin [13] of the bolt into contact with the cocking cam [18], located on the gun housing. Said cam moves said cocking lug and firing pin, as well as the rim retainer plunger, rearward in the bolt against the urging of the spring [16], and holds the firing pin rearward during locking of the bolt. At the end of the ram stroke, the locking lugs [11] of the bolt have been driven forward of the locking lugs [12] of the rotor and have engaged the camming surfaces (FIG. 5) [33] of a locking plunger [32]. Said locking plunger is then pulled radially outward and held by the locking cam [35], the plunger, in turn, rotating to and holding the bolt head in locked position. Rotation of the head into locked position moves cam means [25] so that it will permit the firing pin to move forward in the bolt to strike the primer of the cartridge. At the end of the outward movement of the locking plunger, cocking lug [17] is carried, by continuing rotor rotation, off the cocking cam, whereupon, the continued urging of the spring [16] drives the pin forward to strike the primer of the cartridge and initiate firing.

After a further rotor rotation, during which time elapses to allow projectile ejection and pressure decay in the barrel, the locking plunger [32] contacts the unlocking cam [37] and is driven inward to rotate the bolt head to unlocked position. Rotation of the bolt head, by means of cam means [25] drives the firing pin rearward so that it no longer protrudes forward of the bolt face, but so that the rim retainer plunger still extends over and retains the cartridge case rim in the extractor lip portion [27] of the bolt head. The cam follower roller than enters the extract portion of the bolt drive cam which, during approximately two-thirds gun rotor revolution, drives the bolt rearward, through the crossover, to the rearmost position. As the bolt reaches its rearmost position, the cartridge case contacts housing guide surfaces similar to surfaces [68], and cocking lug [17] contacts retractor cam [19], said cam moving the lug and thereby the rim retainer plunger [23] rearward until it no longer retains the cartridge case rim in the extractor lip portion of the bolt head. The cartridge case is then carried by the sprockets of the unload shaft assembly [52], and guided by the inner guide vanes [46] out of the gun housing. The unload shaft assembly and cooperating guide vanes and surfaces of the turn-around unit then decelerate and guide the cartridge case into a conveyor element for transport out of the gun assembly.

Figure 4:
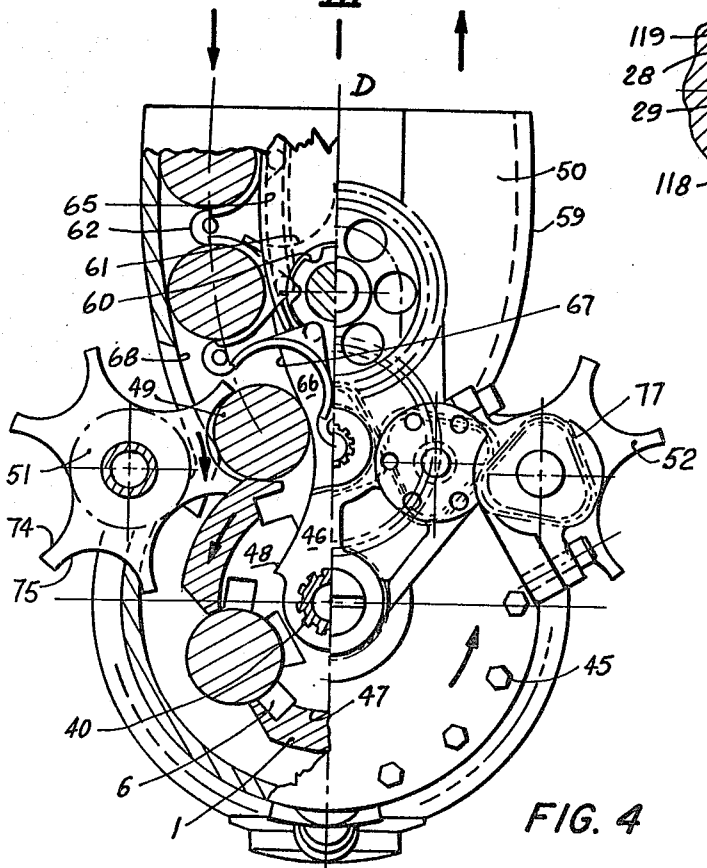
FIG. 4 is a transverse view of the gun of FIG. 1, half of which is in cross-section taken along the plane IV—IV of FIG. 3.
Figure 15:
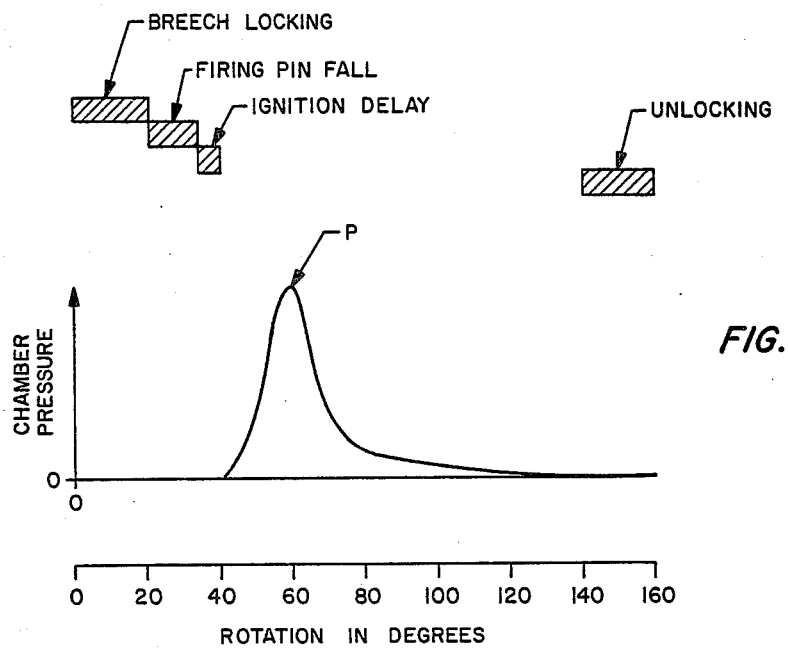
FIG. 15 is a chart of chamber events vs. rotation in the gun of FIG. 1.
Figure 17:
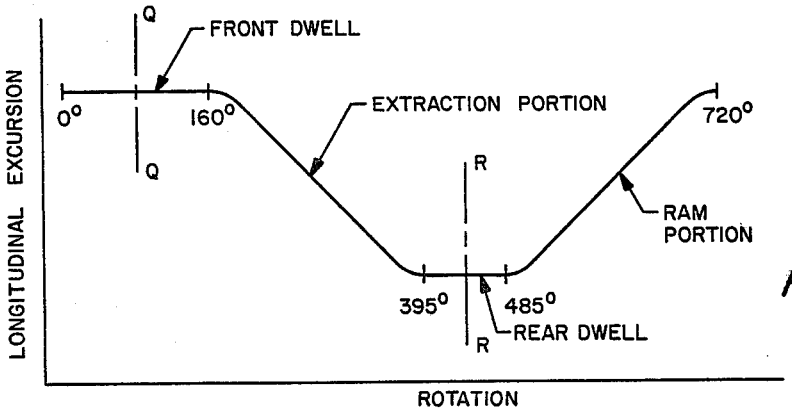
FIG. 17 is a chart for a symmetrical two-revolution cam of rotation vs. longitudinal excursion.

The construction described is substantially symmetrical about center line D—D of FIG. 4, thereby placing the center of gravity on center line D—D at a point close to the upper intersection of said center line and the circle described by the center of the breech end of any of the barrels as the rotor rotates. However, the peak of the recoil force wave does not occur at the center of the front dwell portion of the usual Gatling gun bolt drive cam. FIG. 15 shows the events occurring during the front dwell portion of a two-revolution three barrel 35 mm gun operating at 1,600 shots per minute. At the beginning of the front dwell space, 20 degrees is used to lock the breech, after which the fall of the firing pin and ignition delay consume an additional 20 degrees of rotation before the chamber pressure starts to rise. Chamber pressure reaches its maximum at P, roughly 60 degrees after the start of the front dwell, and thereafter decays. The projectile leaves the muzzle of the barrel at 80 degrees into the front dwell, after which time the propellant gasses are expelled from the muzzle. The front dwell is continued for an additional 80 degrees in order that chamber pressure can fall to approximately 1,000 pounds per square inch by the time the breech is unlocked. As a consequence of the aforesaid events and constraints on the front dwell space, the maximum chamber pressure occurs roughly 20 degrees before the center of front dwell. Because the instantaneous recoil thrust is essentially equivalent to the chamber pressure applied to the barrel bore area of the weapon, the recoil force wave is of the same shape as the chamber pressure curve, and reaches maximum thrust 20 degrees before the center of front dwell. A typical Gatling gun bolt drive cam as applied in a two-revolution gun is diagrammed in FIG. 17. The front dwell portion is symmetrical about center line Q—Q and the rear dwell portion is symmetrical about center line R—R. Note that center lines Q—Q and R—R are 360 degrees of rotation apart, and are therefore coincident. Further, since the slopes of the extraction portion and ram portion are equal, the entire cam is symmetrical with respect to the lines Q—Q and R—R. The rear dwell portion of the cam must also be symmetrical with respect to the load and unload shaft assemblies (51) and (52). Since said assemblies are symmetrical about center line D—D (FIG. 4), the lines Q—Q, R—R, and D—D are all coincident, and since the center of gravity of the weapon lies on center line D—D, it must lie on center line Q—Q of FIG. 17. Since the maximum recoil thrust occurs 20 degrees before the firing barrel crosses center line Q—Q, the peak thrust cannot pass through the center of gravity of the weapon. Therefore, the weapon balance, although much improved over that of a conventional Gatling gun, is not ideal.

Figure 16:
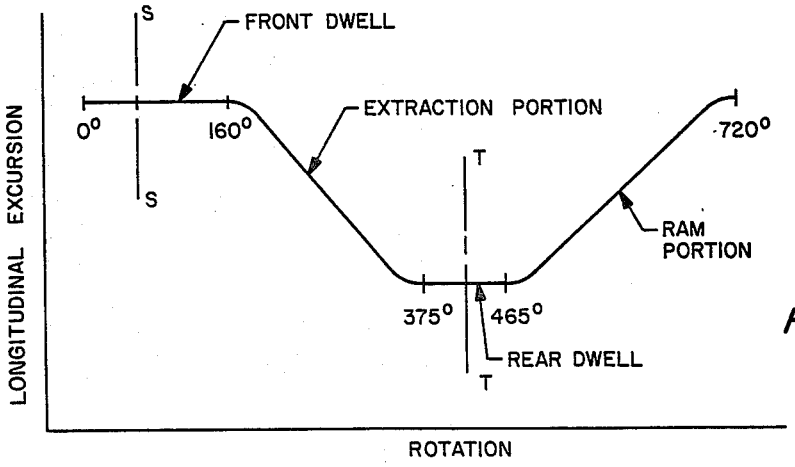
FIG. 16 is a chart for an unsymmetrical two-revolution cam of rotation vs. longitudinal excursion.

The preferred embodiment of the balanced Gatling gun utilizes an unsymmetrical two-revolution cam, the profile of said cam being shown in FIG. 16. The slope of the ram portion of the cam is less than the extraction portion, so that the front dwell portion of the cam is delayed 20 degrees relative to the rear dwell portion. The weapon assembly, symmetrical with respect to center line, D—D is symmetrical with respect to coincident center line, T—T, which bisects the rear dwell portion. Center line S—S, located 360 degrees from line T—T, and therefore coincident with D—D and T—T, intersects the front dwell portion of the cam 20 degrees before the midpoint of said dwell portion. As described above, the peak of the recoil thrust wave occurs when the firing barrel is 20 degrees before the midpoint of the front dwell. Said peak thrust therefore occurs as the firing barrel crosses center line D—D. Since the center of gravity of the weapon is ideally on the axis of the firing barrel as said barrel crosses center line D—D, the recoil thrust wave generated by firing of a cartridge generates no net moment about the center of gravity.

The embodiment of the balanced Gatling gun herein described utilizes a two-revolution cam, that is, a cam which drives the gun bolt through one complete cycle in two complete revolutions of the gun rotor. It should be understood that higher order cams could also be used, especially in conjunction with an unsymmetrical bolt driving cam, to place the firing barrel on the same side of the gun rotor axis as the feed mechanism. For example, a grossly unsymmetrical three-revolution cam could be used in a gun having four barrels. The only theoretical restriction is that the number of gun barrels may not be an integer multiple, nor an integer factor, nor any integer multiple of an integer factor of the number of revolutions of the cam. A two- or four-revolution cam can use any odd number of barrels, but a six-revolution cam, for example, is restricted to use 1, 5, 7, 11, 13, . . . barrels.

What is claimed is:

1. A gun having a longitudinal axis and including:
a gun housing,
a rotor journaled for rotation relative to said housing about said longitudinal axis and having a first plurality of gun barrels and a like plurality of gun bolts;
each of said gun bolts journaled to said rotor for longitudinal reciprocation relative to a respective gun barrel, a cycle of operation of each of said gun bolts including a full cycle of reciprocation, forwardly and aftwardly;
a main cam journaled for rotation relative to said rotor about said longitudinal axis and coupled to each of said gun bolts for driving each of said gun bolts through full cycles of reciprocation;
said main cam having a configuration such that a full cycle of reciprocation of each of said first plurality of gun bolts requires a second plurality of revolutions of said main cam.

2. A gun for firing rounds of ammunition according to claim 1, wherein:
each of said gun barrels has a respective longitudinal axis and is fired in sequence as said rotor and main cam undergo relative rotation, further including:
ancillary means, including a cartridge feeding mechanism and a gun drive mechanism fixed relative to said main cam, and having a center of gravity disposed in a diametral plane which passes through said longitudinal axis of said gun;
each of said gun barrels, in sequence, at its instant of time of maximum recoil thrust during the interval of time during which it is firing its respective round of ammunition, lying within said diametral plane and of the same side of said longitudinal axis as said center of gravity of said ancillary means.

3. A gun according to claim 1 wherein:
said main cam has a nonsymmetrical configuration.

4. A gun according to claim 1 wherein:
said main cam has a two revolution configuration.

5. A gun according to claim 1 wherein:
said main cam is fixed to said housing.

6. A gun according to claim 1 wherein:

said first plurality is not an integer multiple, nor an integer factor of said second plurality.

7. A gun for firing rounds of ammunition according to claim 1, wherein:

each of said gun barrels has a respective longitudinal axis and is fired in sequence as said rotor and main cam undergo relative rotation, further including:

ancillary means including a cartridge feeding mechanism fixed relative to said main cam and having a center of gravity disposed in a diametral plane which passes through said longitudinal axis of said gun;

each of said gun barrels, in sequence, at its instant of time of maximum recoil thrust during the interval of time during which it is firing its respective round of ammunition, lying within said diametral plane and on the same side of said longitudinal axis as said center of gravity of said ancillary means.

8. A gun according to claim 7 wherein:

said main cam has a nonsymmetrical configuration.

9. A gun according to claim 7 wherein:

said main cam has a two revolution configuration.

* * * * *

UNITED STATES PATENT AND TRADEMARK OFFICE

CERTIFICATE OF CORRECTION

PATENT NO. : 4,210,058

DATED : July 1, 1980

INVENTOR(S) : Robert E. Chiabrandy

It is certified that error appears in the above-identified patent and that said Letters Patent are hereby corrected as shown below:

Column 2, line 27 change "Catling" to --Gatling--.

Column 3, line 24 change "radialy" to --radially--.

Column 5, line 11 change "turnaround" to --turn-around--,
line 45 change "[9]" to --[19]--.

Signed and Sealed this

*Fourth* Day of *November 1980*

[SEAL]

*Attest:*

SIDNEY A. DIAMOND

*Attesting Officer*

*Commissioner of Patents and Trademark*